US011298805B2

(12) United States Patent
Johnson

(10) Patent No.: US 11,298,805 B2
(45) Date of Patent: Apr. 12, 2022

(54) TORQUE ASSEMBLY AND REACTION ARM WITH SAFETY TETHER

(71) Applicant: Enerpac UK Ltd, Northumberland (GB)

(72) Inventor: Mike Johnson, Northumberland (GB)

(73) Assignee: Enerpac UK Ltd, Morpeth (GB)

( * ) Notice: Subject to any disclaimer, the term of this patent is extended or adjusted under 35 U.S.C. 154(b) by 0 days.

(21) Appl. No.: 16/618,527

(22) PCT Filed: Jun. 1, 2018

(86) PCT No.: PCT/GB2018/051513
§ 371 (c)(1),
(2) Date: Dec. 2, 2019

(87) PCT Pub. No.: WO2018/220402
PCT Pub. Date: Dec. 6, 2018

(65) Prior Publication Data

US 2020/0164493 A1 May 28, 2020

(30) Foreign Application Priority Data

Jun. 2, 2017 (GB) ..... 1708826

(51) Int. Cl.
*B25B 21/00* (2006.01)
*B25B 23/00* (2006.01)
(Continued)

(52) U.S. Cl.
CPC ..... *B25B 21/005* (2013.01); *B25B 23/0078* (2013.01); *B25B 13/481* (2013.01);
(Continued)

(58) Field of Classification Search
CPC . B25B 23/0078; B25B 23/0035; B25B 23/14; B25B 21/005; B25B 21/007; B25B 13/481
See application file for complete search history.

(56) References Cited

U.S. PATENT DOCUMENTS 1,516,099 A 11/1924 Hill
6,068,068 A 5/2000 Turoff
(Continued)

FOREIGN PATENT DOCUMENTS

CN 106737348 A 5/2017
GB 2524825 A 10/2015
(Continued)

OTHER PUBLICATIONS

International Search Report with Written Opinion for related Application No. PCT/GB2018/051513 dated Sep. 17, 2018 (8 Pages).
(Continued)

*Primary Examiner* — David B. Thomas
(74) *Attorney, Agent, or Firm* — Michael Best & Friedrich LLP

(57) ABSTRACT

A torque wrench assembly comprises a torque wrench and a reaction arm and locking means for locking together the torque wrench and the reaction arm. The locking means comprises a connection member located on the torque wrench; an opening on the reaction arm for receipt of the connection member of the torque wrench; a locking member slidably mounted in a channel on the reaction arm, the locking member including an aperture sized to allow the connection member to pass therethrough; and biasing means arranged to bias the locking member into a position wherein the aperture is partially aligned with the opening. The connection member has an insertion end for insertion into the opening of the reaction arm, and immediately adjacent
(Continued)

the insertion end is a recess. The recess is shaped to receive a part of the locking member.

18 Claims, 8 Drawing Sheets

(51) Int. Cl.
*B25B 23/14* (2006.01)
*B25B 13/48* (2006.01)

(52) U.S. Cl.
CPC ..... *B25B 21/007* (2013.01); *B25B 23/0035* (2013.01); *B25B 23/14* (2013.01)

(56) References Cited

U.S. PATENT DOCUMENTS 7,013,760 B1 3/2006 Kennison
8,261,642 B2 * 9/2012 Brandstrom ..... B25B 23/0078 81/469
9,016,173 B1 * 4/2015 Saftoiu ..... B25B 21/005 81/57.4
9,056,390 B2 * 6/2015 Hellstrom ..... B25B 23/0078
9,308,632 B2 * 4/2016 Junkers ..... B25B 21/00
2002/0073808 A1 * 6/2002 Jamra ..... B25B 23/0078 81/57.39
2006/0053981 A1 * 3/2006 Shaw ..... B25B 21/005 81/57.39
2016/0207180 A1 * 7/2016 Hohmann ..... B25B 21/00

FOREIGN PATENT DOCUMENTS

GB 2558887 A 7/2018
JP H1044052 A 2/1998

OTHER PUBLICATIONS

Examination Report issued from the European Patent Office for related Application No. 18 706 544.6 dated Apr. 6, 2021 (4 Pages).
Examination Report issued from the United Kingdom Patent Office for related Application No. GB1708826.1 dated Sep. 29, 2021 (3 Pages).
First Office Action issued from the Chinese Patent Office for related Application No. 201880050032.9 dated Feb. 22, 2021 (7 Pages—English Translation).
Second Office Action issued from the Chinese Patent Office for related Application No. 201880050032.9 dated Oct. 20, 2021 (4 Pages including the Statement of Relevance).

* cited by examiner

TORQUE ASSEMBLY AND REACTION ARM WITH SAFETY TETHER

FIELD OF THE INVENTION

The present invention relates to torque wrenches and in particular to a torque wrench mounting a reaction arm and a tether arrangement for such torque wrench and reaction arm assemblies.

BACKGROUND OF THE INVENTION

Hydraulic torque wrenches are used widely, particularly in the oil and gas industries. Torque wrenches require some form of reaction member or reaction arm that engages with an immovable object to prevent the wrench from spinning about the component that is to be tightened or loosened. It is usually necessary to adjust the position the reaction arm on the torque wrench so that the reaction arm is in engagement with the immovable object. When carrying our a particular task, such as bolting up a flange connection it might be necessary to re-orientate the reaction arm on the torque wrench a number of times.

GB2524825 describes a torque wrench which couples to a reaction arm using a quick release mechanism.

An improved arrangement for attaching a torque wrench to a reaction arm is described in the applicant's pending United Kingdom patent application number 1700597.6 which is incorporated herein by reference.

Torque wrenches are often used when working at height. In order to adjust the position of the torque wrench relative to the reaction arm it is necessary to release the reaction arm and slide it from the torque wrench. The reaction arm is rotated relative to the torque wrench to a desired position and re-attached to the torque wrench. During this procedure there is a risk of the reaction arm falling as the operator attempts to manipulate its position.

It would therefore be desirable to reduce the possibility of a reaction arm and/or torque wrench falling with the potentially disastrous consequences that might follow.

The present invention provides arrangements of safety tethers which reduce the risk of a reaction arm and/or torque wrench falling.

SUMMARY OF THE INVENTION

According to a first aspect of the invention there is provided a torque wrench assembly comprising a torque wrench, a reaction arm and a tether having a first end and a second end, the first end attached to the torque wrench and wherein the reaction arm includes an aperture and the tether passes through the aperture and wherein the second end of the tether comprises a stop member, at least a part of the stop member being wider than the aperture, and wherein the reaction arm is slidable relative to and rotatable about the tether when released from the torque wrench.

Preferably, the tether comprises a flexible elongate element and the stop member is attached to the flexible element. Preferably, the flexible element is comprised of a wire rope. Advantageously, the stop member comprises first and second components, releasably attachable to each other, and wherein one of the first and second components is so shaped and dimensioned as to pass through the aperture and the other of the first and second components is wider than the aperture.

The first component may comprise a ferrule attached to one end of the flexible element. The second component may comprise a keeper. The second component may be attachable to the ferrule. The keeper may include a nut. The keeper may include a washer.

The first end of the tether may include a connection member. The connection member may be releasably attachable to the torque wrench. The connection member may include a threaded portion for connection with a correspondingly threaded part of the torque wrench. The connection member may include a recess configured to receive a slidably mounted locking member of the reaction arm.

The reaction arm may be a reaction arm according to the second aspect of the invention described below.

According to a second aspect of the invention there is provided a reaction arm that is attachable to a torque wrench, wherein the reaction arm includes a wall having a circular cross section the wall including a seat configured to receive a ring, wherein the ring rotatable around the said wall of the reaction arm, and wherein the ring includes an attachment element.

The attachment element is adapted to attach to a tether, clip or the like.

Preferably, the attachment element is a shackle.

Preferably, the ring comprises two parts, wherein the two parts are joined together by a hinge at one side and by a releasable fastener at the other side. When mounted on the reaction arm the hinge is on one side of the reaction arm and the releasable fastener on the other.

The releasable fastener may form part of the shackle. Preferably, the shackle includes a shackle body and a shackle pin and the releasable fastener is the shackle pin.

Advantageously, the seat is a groove formed in or on the wall of the reaction arm. The seat may be formed as a recess in the wall of the reaction arm or by spaced apart up stands formed on the wall of the reaction arm.

An elongate attachment member may be attached to the attachment element of the reaction arm at a first end, a second end of the elongate attachment member attachable to another object for securing the assembly when not supported by an operator.

A third aspect of the invention comprises a torque wrench assembly comprising a torque wrench, a reaction arm according to the second aspect of the invention.

BRIEF DESCRIPTION OF THE DRAWINGS

In the Drawings, which illustrate preferred embodiments of a torque wrench according to the invention.

DETAILED DESCRIPTION OF THE PRIOR ART AND PREFERRED EMBODIMENTS OF THE INVENTION

Figure 1A:
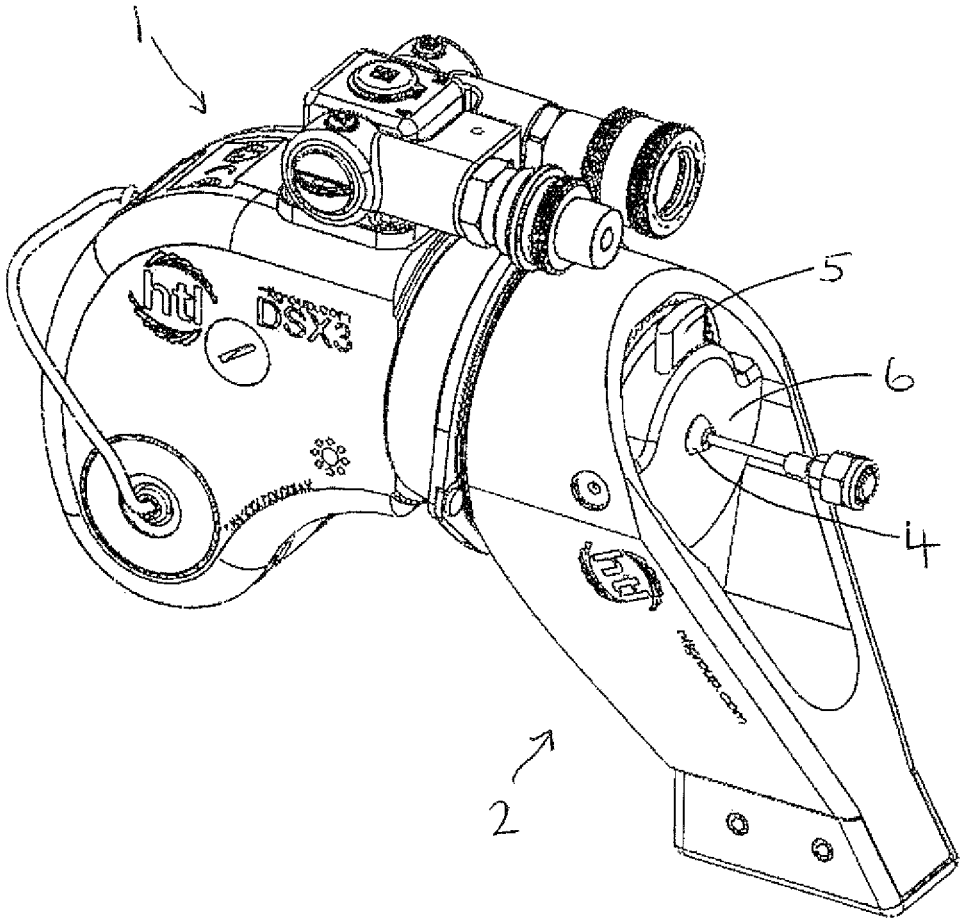
FIG. 1*a* is a schematic representation of an assembled hydraulic torque wrench and reaction arm in a neutral position.

FIG. 1 illustrates a torque wrench 1 and a reaction arm 2. The torque wrench 1 is provided with a connection member 3 and the reaction arm 2 includes an opening 12 (see FIG. 7*a*) for receiving the connection member 3. In the illustrated embodiment the reaction arm 2 also includes a back plate 6 with a hole 4 therein, into which the connection member 3 locates. The reaction arm 2 includes a locking member 5 which is slidably mounted in a channel 10. The locking member 5 includes an aperture 7 sized to allow the connection member 3 to pass therethrough.

The locking member 5 has an upper end which protrudes from the reaction arm 2, as shown in the drawings, and a lower end which is connected to a spring 8. The spring is arranged to bias the locking member 5 so that it protrudes from the reaction arm 2 as shown. When the locking member 5 is at rest the aperture 7 is partially overlaps with openings 4 and 12 for receiving the connection member 3.

Figure 3A:
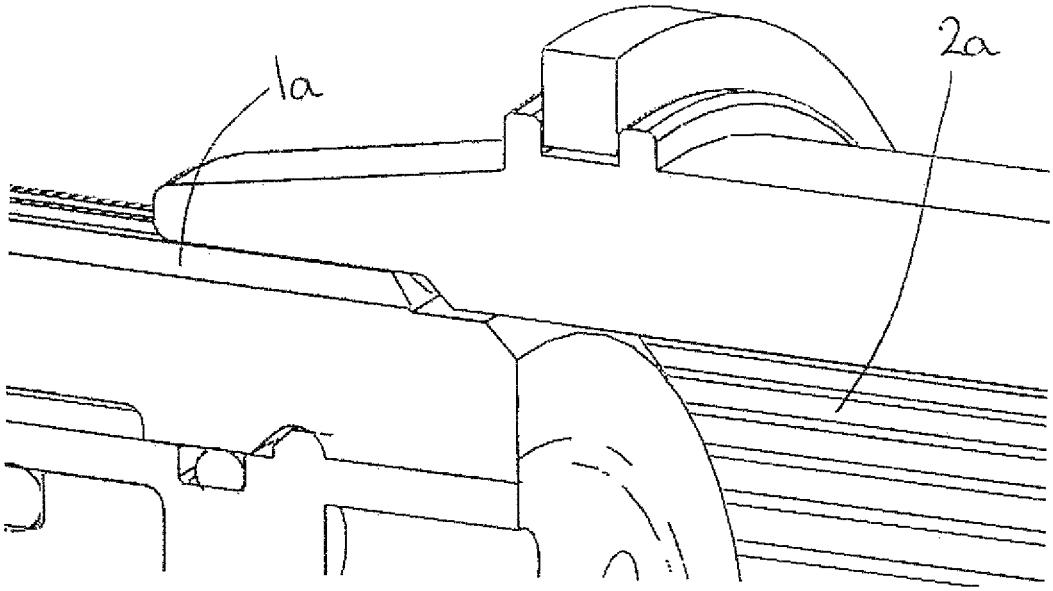
FIG. 3*a* is an exploded view of splined parts of the hydraulic torque wrench and reaction arm when the reaction arm is in the position shown in FIGS. 2*a* and 2*b;*
Figure 3B:
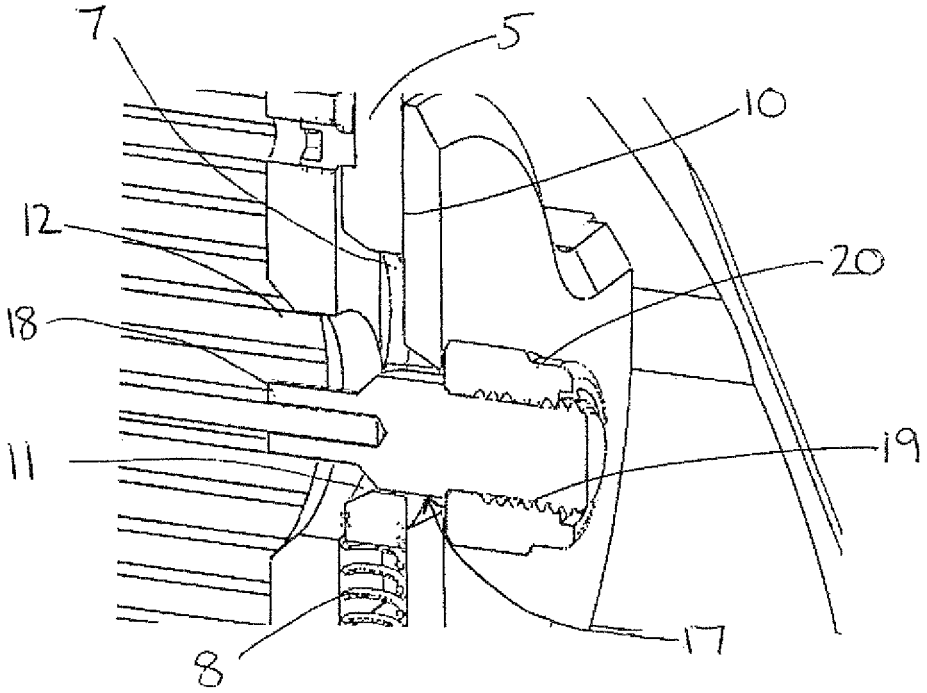
FIG. 3*b* is an exploded view illustrating the interaction of the tether, the hydraulic torque wrench and the reaction arm.

As shown in FIG. 3*b*, when the connection member 3 of the torque wrench 1 is pushed into the opening 12 of the reaction arm 2, the end of the connection member 3 pushes down on the chamfered edge 11 of the aperture 7 which then pushes the locking member 5 downwards against the force of the spring 8. The part of the aperture 7 with larger diameter is now aligned with the opening 12, allowing the end of the connection member 3 to pass through the aperture 7 and locate in the hole 4 in the back plate 6. The connection member 3 includes a recess 9 located adjacent to the tapered end shaped to receive part of the locking member 5.

Figure 1B:
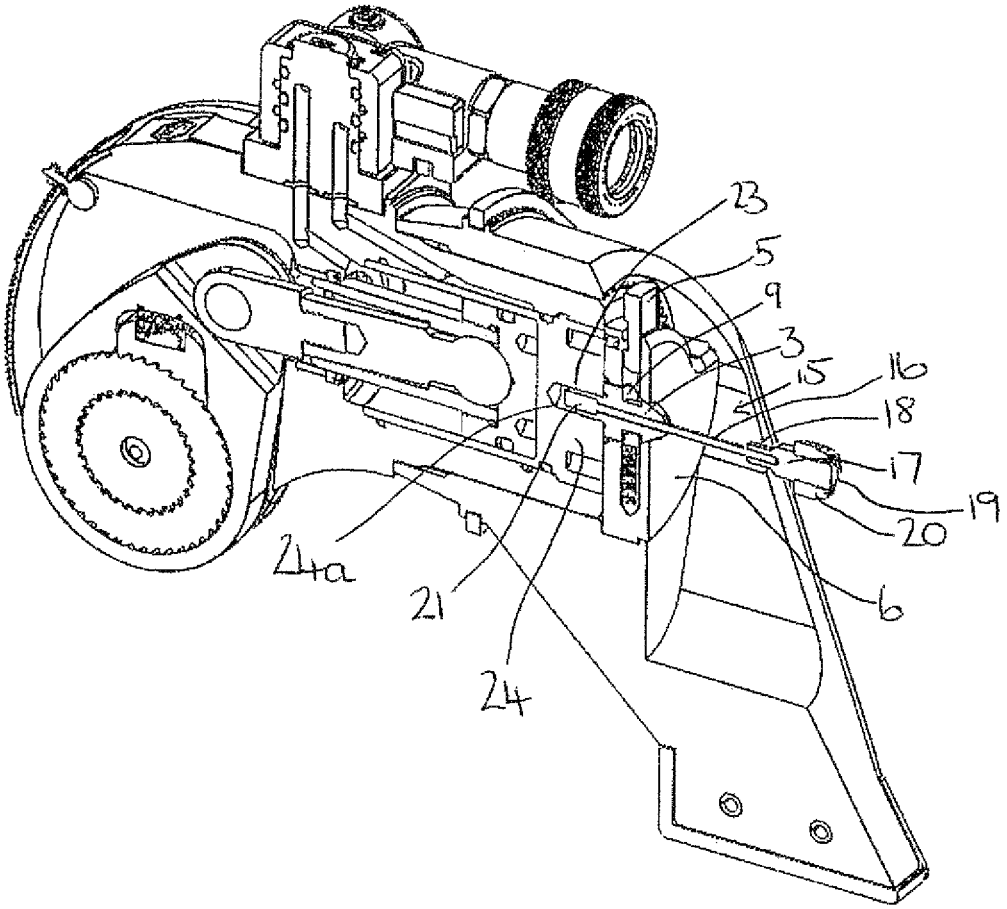
FIG. 1*b* is a schematic cross-section of the assembled hydraulic torque wrench and reaction arm of FIG. 1*a;*
Figure 2A:
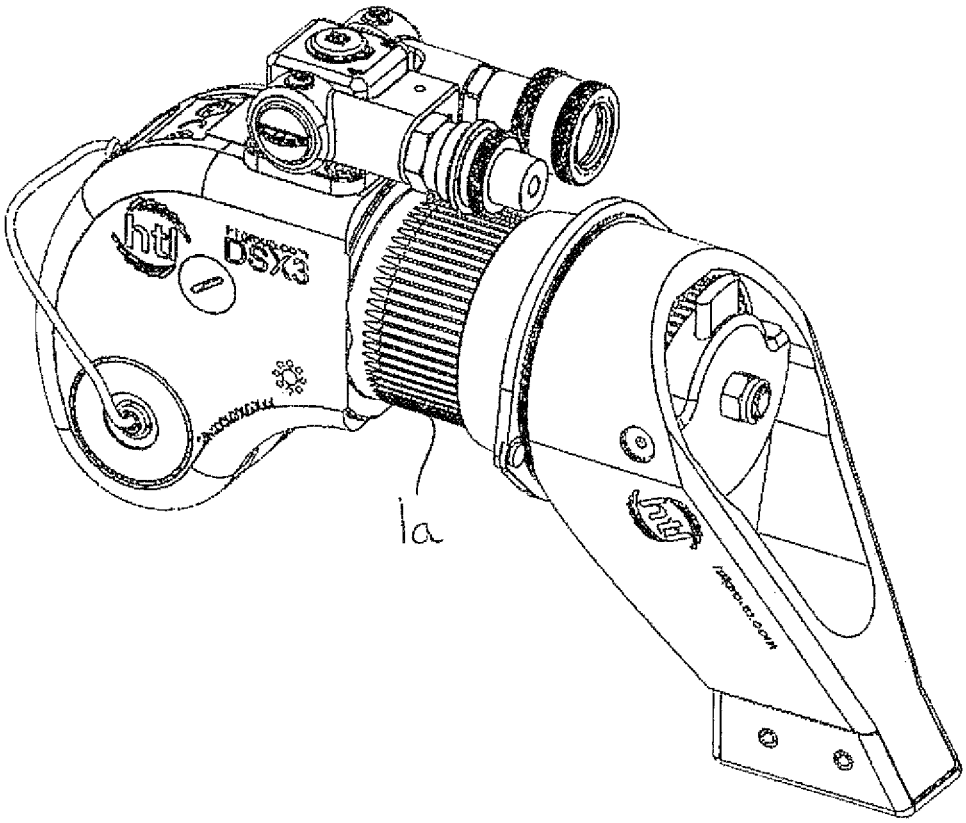
FIG. 2*a* is a schematic representation of the assembled hydraulic torque wrench and a reaction arm of FIG. 1, with the reaction arm moved to an extended position.
Figure 2B:
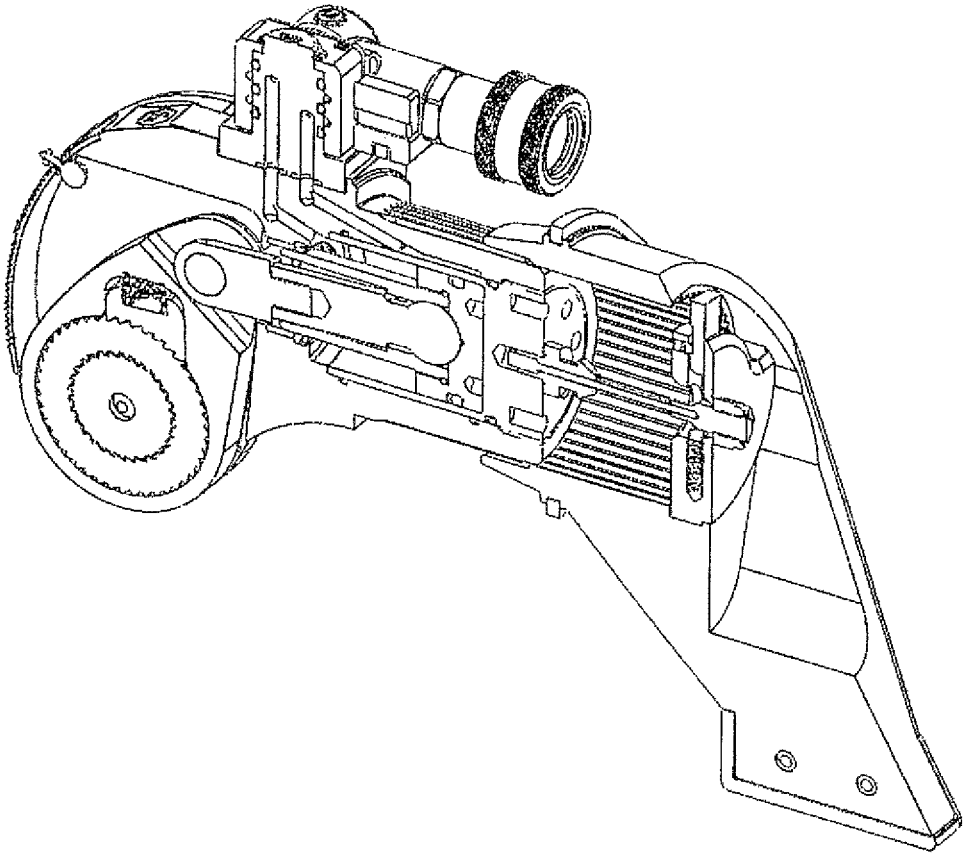
FIG. 2*b* is a schematic cross-section of the hydraulic torque wrench and reaction arm illustrated in FIG. 2*a;*

As shown in FIG. 1*b*, once the tapered end of the connection member 3 has passed through the aperture 7 of the locking member 5, the locking member 5 springs up automatically and locks into the recess 9 behind the end of the connection member 3 due to the force exerted by the spring. The torque wrench 1 and reaction arm 2 are now securely locked together since the aperture 7 of the locking member is not aligned with the opening 12 on the reaction arm and the two devices cannot be unlocked without some manual intervention.

To unlock the reaction arm 2 from the torque wrench 1, the user simply presses down on the upper end of the locking member 5, and this causes the locking member 5 to slide towards the spring and causes the aperture 7 to fully align with the first opening 12, allowing the connection member 3 of the torque wrench 1 to be withdrawn from the reaction arm 2, uncoupling the two devices.

The connection member 3 is mounted on a tether 15. The connection member includes a bore 21 extending through the connection member 3 on the centre axis thereof. One end of the connection member 3 has a threaded outer wall 23 for attachment of the connection member 3 to a component 24 of the torque wrench 1. The component 24 includes an internally threaded bore 24*a*. The threaded outer wall 23 of the connection member engages with the internally threaded bore 24*a* to secure the connection member 3 to the torque wrench 1. The tether 15 includes an end-stop 23 which engages in a bore 21 formed in the end of the connection member 3.

The tether 16 further comprises a flexible elongate element in the form of a wire rope 16 in the present example. The above-mentioned end stop 21 is attached to one end of the wire rope 16, with a ferrule 17 attached to the other end of the wire rope 16. The ferrule 17 includes an attachment portion 18 which receives and connects to the wire rope 16 and an externally threaded portion 19 which receives an internally threaded nut 20. The nut 20 is removable so that the reaction arm 2 may be detached completely from the torque wrench 1.

Figure 4A:
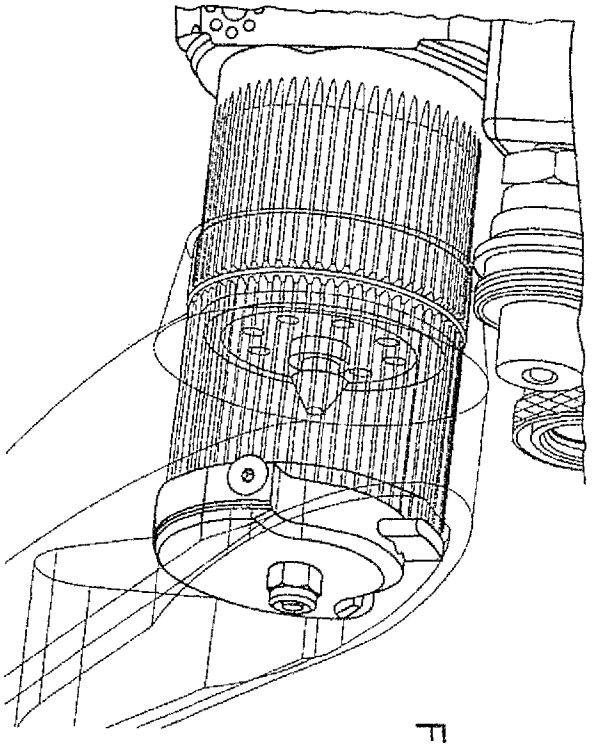
FIG. 4*a* exploded schematic representation of the reaction arm in a fully extended configuration with respect to the hydraulic torque wrench.
Figure 4B:
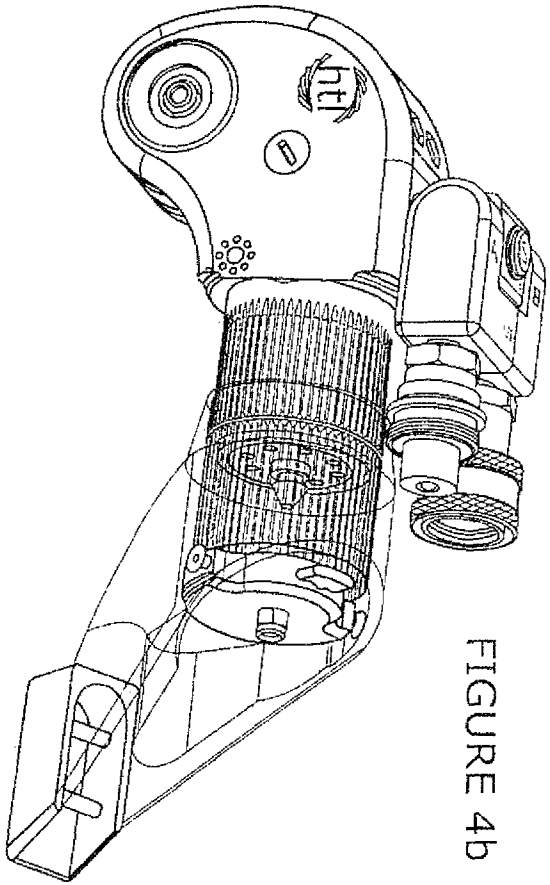
FIG. 4*b* illustrates rotation of the reaction arm to a new position.
Figure 5:
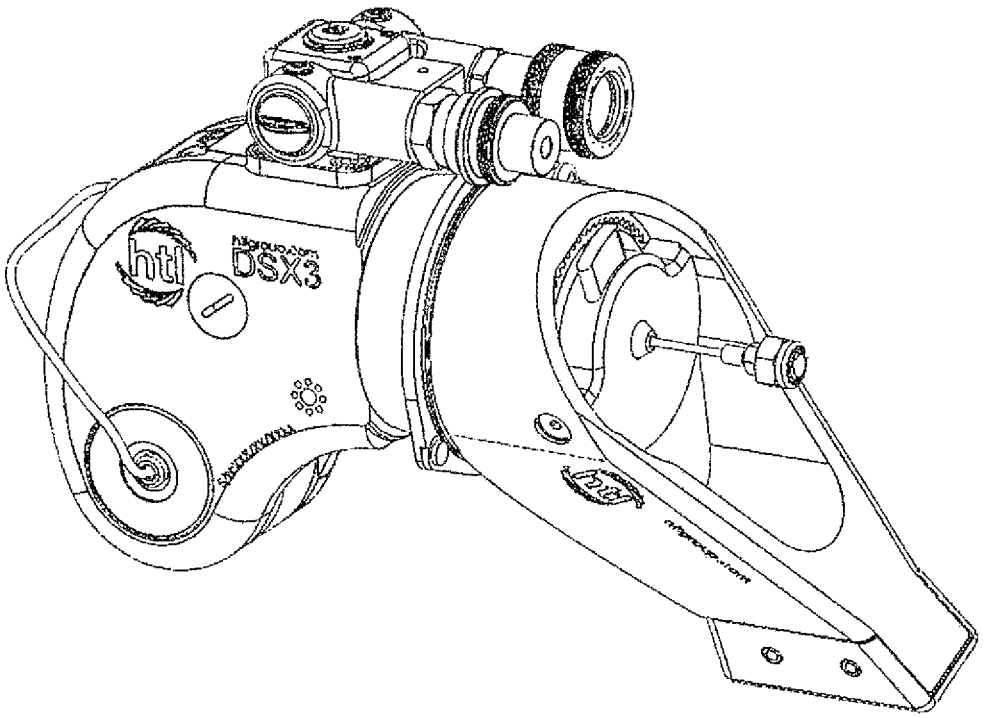
FIG. 5 illustrates the reaction arm locked to the hydraulic torque wrench in the new position showing FIG. 4*b;*

The tether 15 allows the reaction arm 2 to be moved axially with respect to the torque wrench 1 and rotated relative thereto for repositioning of the reaction arm 2 relative to the torque wrench 1. As can be seen best in FIGS. 2*a*, 2*b*, 3*a*, 4*a* and 4*b* the torque wrench 1 and the reaction arm 2 include respective internally and externally splined portions 1*a*, 2*a*. When the locking member 5 is depressed to release the reaction arm 2 from engagement with the torque wrench 1 the reaction arm may slide relative to the torque wrench 1 along the spines 1*a*, 2*a*. The tether 15 is configured such that when the back plate 6 of the reaction arm 2 engages with the nut 20 the splines 2*a* are clear of the splines 1*a*, thereby allowing the reaction arm 2 to rotate to a new position, as showing FIGS. 3*a*, 4*a* and 4*b*. Once the desired position of the reaction arm 2 has been obtained the operator slides the reaction arm 2 on the splines 1*a*, 2*a* towards the torque wrench 1 until the lock 5 engages the recess 9 in the connection member 3.

Referring now to FIGS. 6 to 10, the reaction arm 2 comprises an outer wall 2*b* in which a slip ring seat is formed. In the illustrated embodiment the slip ring seat is formed as a channel 2*c*. The channel 2*c* may be formed by reducing the thickness of the outer wall 2*b*, thereby forming a groove, or by forming spaced apart up-stands extending around the outer wall 2*b*.

A slip ring 10 comprises two parts 10*a*, 10*b* connected together by a hinge 10*c*. The free ends 10*e*, 10*d* of the respective parts 10*a*, 10*b* each comprise a hole 10*e*', 10*d*'. The free ends 10*e*, 10*d* are each offset so that when the free ends 10*e*, 10*d* are brought together they overlap one another and the holes 10*e*', 10*d*' align. A shackle 11 comprises a shackle pin 11*b* and a shackle body 11*a*. With the holes 10*e*', 10*d*' aligned the shackle body 11*a* is positioned so that the shackle pin 11*b* may pass through holes in the shackle body 11*a* and the aligned holes 10*e*', 10*d*'.

Figures 6, 7, 8, 9, 10:
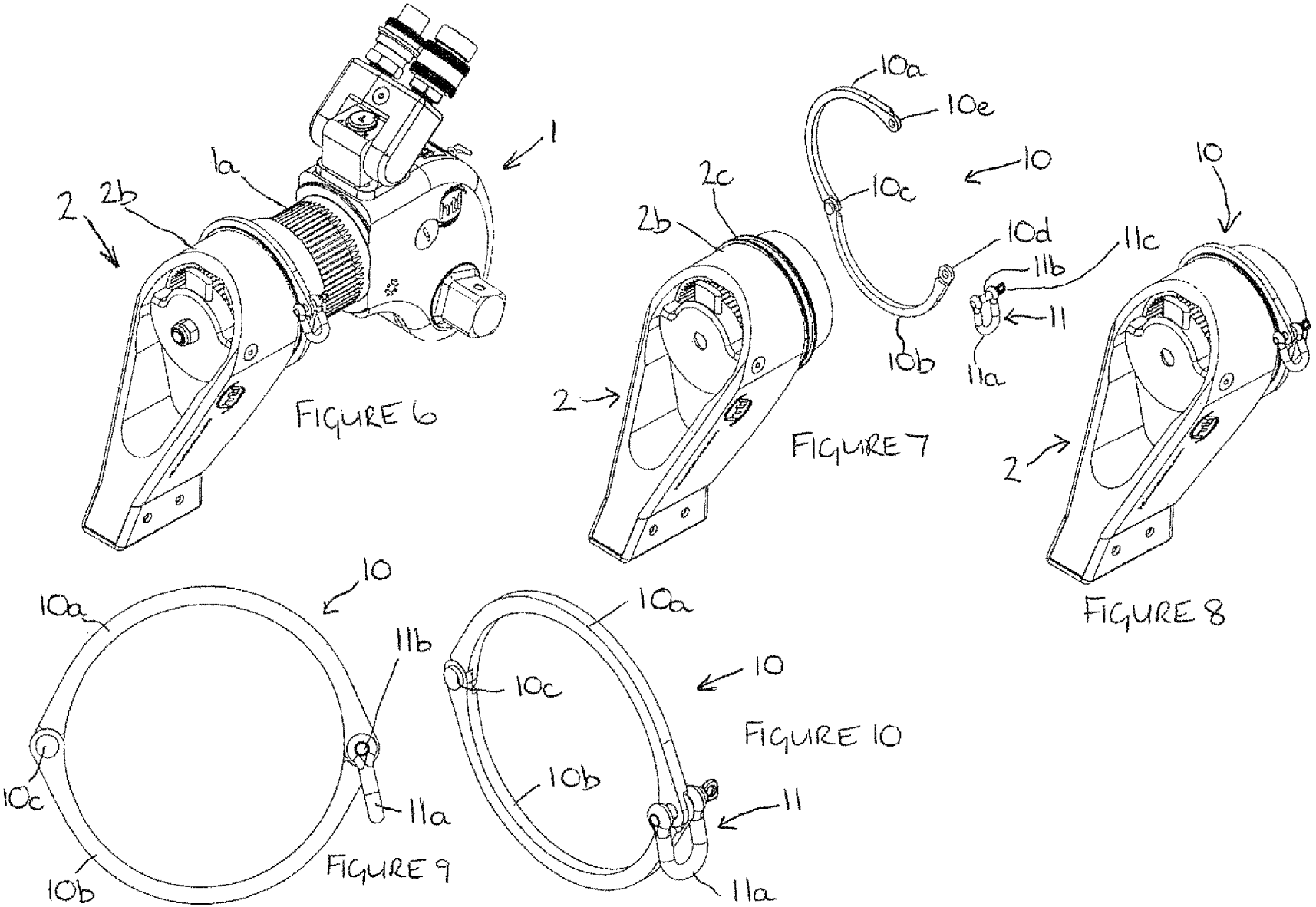
FIG. 6 is a schematic representation of an alternative embodiment of a torque wrench of the invention.
FIG. 7 is an exploded view of a reaction arm assembly forming part of the torque wrench shown in FIG. 6.
FIG. 8 is a schematic representation of the assembled reaction arm illustrated in FIG. 7.
FIG. 9 is a front view of a ring of the reaction arm assembly illustrated in FIGS. 7 and 8.
FIG. 10 is an oblique view of the ring illustrated in FIG. 9.

The slip ring 10 is shown in its closed configuration in FIGS. 8, 9 and 10. It will be appreciated from FIG. 8 in particular that the reaction arm 2, and hence the torque wrench when attached thereto may be secured to an immovable object by attaching a lanyard (which may be in the form of a chain or rope) or the like to the immovable object and the shackle 11. The provision of ring 10 as a slip ring allows the reaction arm 2 to be repositioned relative to the torque wrench 1 as discussed above in relation to FIGS. 1 to 5.

Whilst FIGS. 6 to 10 show a reaction arm 2 and torque wrench 1 of the type described in United Kingdom patent application number 1700597.6 the slip ring and slip ring seat described in relation to those figures may be used with other types of reaction arm, reaction arm and torque wrench assemblies.

The torque wrench assembly of the invention provides an improved mechanism for securely locking together a torque wrench and a reaction arm without the requirement for user input prior to assembly of the two devices.

The invention claimed is:

1. A torque wrench assembly comprising a torque wrench, a reaction arm and a tether having a first end and a second end, the first end attached to the torque wrench and wherein the reaction arm includes an aperture and the tether passes through the aperture and wherein the second end of the tether comprises a stop member, at least a part of the stop member being wider than the aperture, and wherein the reaction arm is slidable relative to and rotatable about the tether when released from the torque wrench.

2. A torque wrench assembly according to claim 1, wherein the tether comprises a flexible elongate element and the stop member is attached to the flexible element.

3. A torque wrench assembly according to claim 1, wherein the flexible element is comprised of a wire rope.

4. A torque wrench assembly according to claim 1, wherein the stop member comprises first and second components, releasably attachable to each other, and wherein one of the first and second components is so shaped and dimensioned as to pass through the aperture and the other of the first and second components is wider than the aperture.

5. A torque wrench assembly according to claim 1, wherein the first end of the tether includes a connection member.

6. A torque wrench assembly according to claim 5, wherein the connection member is releasably attachable to the torque wrench.

7. A torque wrench assembly according to claim 6, wherein the connection member includes a recess configured to receive a slidably mounted locking member of the reaction arm.

8. A torque wrench assembly according to claim 1, wherein the reaction arm includes a wall having a circular cross section the wall including a seat configured to receive a ring, wherein the ring rotatable around the said wall of the reaction arm, and wherein the ring includes an attachment element.

9. A reaction arm that is attachable to a torque wrench, wherein the reaction arm includes a wall having a circular cross section the wall including a seat configured to receive a ring, wherein the ring rotatable around the said wall of the reaction arm, and wherein the ring includes an attachment element.

10. A reaction arm according to claim 9, wherein the attachment element is adapted to attach to a tether, clip or the like.

11. A reaction arm according to claim 10, wherein the attachment element is a shackle.

12. A reaction arm according to claim 9, wherein the ring comprises two parts, wherein the two parts are joined together by a hinge at one side and by a releasable fastener at the other side.

13. A reaction arm according to claim 9, wherein the releasable fastener forms part of the shackle.

14. A reaction arm according to claim 13, wherein the shackle includes a shackle body and a shackle pin and the releasable fastener is the shackle pin.

15. A reaction arm according to claim 9, wherein the seat is a groove formed in or on the wall of the reaction arm.

16. A reaction arm according to claim 15, wherein the seat is formed as a recess in the wall of the reaction arm or by spaced apart up stands formed on the wall of the reaction atm.

17. A reaction arm according to claim 9, wherein an elongate attachment member is attached to the attachment element of the reaction arm at a first end, a second end of the elongate attachment member attachable to another object.

18. A torque wrench assembly comprising a torque wrench, and a reaction arm according to claim 9.

* * * * *